US007677434B2

(12) United States Patent
Fry

(10) Patent No.: US 7,677,434 B2
(45) Date of Patent: Mar. 16, 2010

(54) CONTAINERS WITH TAPERED SIDEWALLS AND STACKING TABS

(75) Inventor: Stanley L. Fry, West Covina, CA (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/303,898

(22) Filed: Dec. 19, 2005

(65) Prior Publication Data

US 2006/0091194 A1 May 4, 2006

Related U.S. Application Data

(63) Continuation of application No. 10/392,035, filed on Mar. 19, 2003, now abandoned.

(60) Provisional application No. 60/365,481, filed on Mar. 19, 2002, provisional application No. 60/414,099, filed on Sep. 27, 2002.

(51) Int. Cl.
*B65D 5/00* (2006.01)

(52) U.S. Cl. ..... 229/174; 229/164; 229/915; 229/113; 229/120; 229/191

(58) Field of Classification Search ..... 229/174, 229/112, 164, 918, 919, 917, 191, 169, 170, 229/175

See application file for complete search history.

(56) References Cited

U.S. PATENT DOCUMENTS 49,866 A 9/1865 Doolittle
1,088,383 A 2/1914 Veeder
1,122,522 A 12/1914 Mandeville et al.
1,917,132 A * 7/1933 Labombarde ..... 229/114
2,076,018 A 4/1937 Ferguson (Continued)

FOREIGN PATENT DOCUMENTS

FR 1.427.904 12/1964

(Continued)

*Primary Examiner*—Tri M Mai
(74) *Attorney, Agent, or Firm*—Matthew M. Eslami; Thomas W. Barnes; Dennis H. Lambert

(57) ABSTRACT

A stackable container has a bottom panel, upstanding sidewalls, upstanding end walls, and an open top. According to one aspect of the invention, narrow reinforcing flaps are attached to the upper edge of at least one of the side and end walls, defining a stacking ledge and reinforcing the walls against outward bulge. The reinforcing flaps extend over only a small portion of the height of the side or end wall, and corner post flaps extend from opposite ends of the reinforcing flaps, extending diagonally across interior corners of the container. According to another aspect, the side and/or end walls lean inwardly, defining a narrower footprint at the top of the container than at the bottom. In a specific embodiment one of the walls leans in more than the other. According to a further aspect, an indexing and aligning tab extends upwardly from an upper edge of the container, and a complementary notch is formed in a lower edge for receiving the tab when the containers are stacked. According to a still further aspect, stacking tabs extend upwardly from the upper edge of the container, and slots are formed in the bottom panel for receiving the tabs when containers are stacked. Locking flaps extend into the slots to frictionally engage and hold the tabs.

9 Claims, 13 Drawing Sheets

U.S. PATENT DOCUMENTS

| | | | | | |
|---|---|---|---|---|---|
| 2,195,236 | A | | 3/1940 | Brunt et al. | |
| 2,572,610 | A | | 10/1951 | Gilbert | |
| 2,615,611 | A | | 10/1952 | Paul et al. | |
| 2,646,915 | A | | 7/1953 | Bockmann | |
| 2,657,849 | A | * | 11/1953 | Paul et al. | 229/112 |
| 2,678,765 | A | | 5/1954 | Ferguson et al. | |
| 2,690,285 | A | | 9/1954 | Main | |
| 2,749,011 | A | | 6/1956 | Lebow | |
| 2,771,232 | A | | 11/1956 | Reed | |
| 2,804,252 | A | | 8/1957 | Nute | |
| 2,979,250 | A | | 4/1961 | Hobbs | |
| 3,036,753 | A | | 5/1962 | David et al. | |
| 3,511,430 | A | | 5/1970 | Chuber et al. | |
| 3,524,579 | A | | 8/1970 | Conescu | |
| 3,531,043 | A | | 9/1970 | Charlson et al. | |
| 3,687,354 | A | * | 8/1972 | Jennings | 229/174 |
| 3,731,872 | A | | 5/1973 | McCormick | |
| 3,871,570 | A | | 3/1975 | Garmon | |
| 4,055,293 | A | * | 10/1977 | Stramaglia | 229/175 |
| 4,151,948 | A | | 5/1979 | de la Fuente, Jr. | |
| 4,211,324 | A | | 7/1980 | Ohlbach | |
| 4,245,773 | A | * | 1/1981 | Stollberg | 206/509 |
| 4,529,117 | A | | 7/1985 | Brundage | |
| D307,109 | S | * | 4/1990 | Dasher et al. | D9/418 |
| 5,294,044 | A | | 3/1994 | Clark | |
| 5,860,590 | A | * | 1/1999 | Blomfield et al. | 229/165 |
| 5,996,795 | A | | 12/1999 | Kellar | |
| 6,131,805 | A | | 10/2000 | Gasior | |
| 6,158,652 | A | * | 12/2000 | Ruiz et al. | 229/178 |
| 6,186,393 | B1 | * | 2/2001 | Tsamourgelis | 229/122.26 |
| 6,270,009 | B1 | | 8/2001 | Heeren | |
| 6,296,178 | B1 | | 10/2001 | McKenner, Sr. | |
| 6,354,487 | B1 | | 3/2002 | Muise, Jr. | |
| 6,443,358 | B1 | | 9/2002 | Schilling | |
| 6,460,758 | B1 | | 10/2002 | Fenton et al. | |
| 6,481,619 | B1 | * | 11/2002 | Jackson | 229/169 |
| 6,502,698 | B1 | | 1/2003 | McKenna et al. | |
| 6,508,395 | B2 | | 1/2003 | McLeod | |
| 6,568,588 | B2 | | 5/2003 | Holdsworth | |
| 6,581,772 | B2 | | 6/2003 | Noland | |
| 6,641,032 | B1 | * | 11/2003 | Schilling | 229/174 |
| 6,719,191 | B1 | * | 4/2004 | Christensen et al. | 229/122.26 |
| 6,899,266 | B2 | * | 5/2005 | Conway | 229/169 |
| 7,207,473 | B2 | * | 4/2007 | Fry | 229/174 |
| 2002/0125308 | A1 | | 9/2002 | McLeod | |
| 2002/0179481 | A1 | | 12/2002 | Noland | |
| 2003/0038051 | A1 | | 2/2003 | Bennett et al. | |
| 2004/0256448 | A1 | | 12/2004 | Blomfield et al. | |

FOREIGN PATENT DOCUMENTS

| | | |
|---|---|---|
| GB | 962191 | 8/1962 |
| WO | WO 99/43560 | 9/1999 |

* cited by examiner

CONTAINERS WITH TAPERED SIDEWALLS AND STACKING TABS

RELATED APPLICATIONS

This application is a continuation of U.S. patent application Ser. No. 10/392,035, filed Mar. 19, 2003, now abandoned which claims the benefit of U.S. Provisional Application Ser. Nos. 60/365,481 filed Mar. 19, 2002, and 60/414,099 filed Sep. 27, 2002, the disclosures of which are incorporated herein by reference.

FIELD OF THE INVENTION

The present invention relates to a container made of a flexible material, erected from a unitary paperboard blank, for the holding, stacking and transporting of various items such as agricultural produce. In particular, the present invention relates to a container having tapered opposing walls and tapered stacking tabs extending from and coplanar with the tapered walls, locks scored and cut in a base panel of the container for accepting and securing the tapered stacking tabs of an adjacently stacked container, a partial reinforcing top structure, and corner posts.

BACKGROUND OF THE INVENTION

Corrugated paperboard is typically used in many different applications, for example, to form containers, boxes, cartons, or dividers for holding, storing, stacking or shipping various items such as agricultural produce.

Typically, such containers have a bottom and four sidewalls, and are formed from a blank scored with score lines or cut lines. The blanks are most often formed by automated machines in a continuous in-line process involving cutting, scoring and molding continuous sheets of paperboard. The paperboard is then folded along the score lines or cut lines to form a container. The blanks may be folded into a container by an automated machine or by a consumer.

During use, containers are often stacked on top of one another for ease of shipping and for optimum use of space. In these circumstances, it is possible for containers to have stacking tabs extending upward from the top edge of the container's sidewalls. These stacking tabs often fit into corresponding notches cut into an adjacently stacked container to help secure the stack. Since containers are usually stacked on top of like sized containers, the stacking tabs that extend upward from a lower container's sidewalls position directly into the sidewalls of a higher, adjacent container. Thus, to accommodate the lower container's tabs, a complementary notch must be cut out of the higher container's sidewalls. However, a notch in a sidewall is problematic in that it does not secure the stacking tab on all four sides. Thus, these sidewall notches do not fully prevent side-to-side movement, subjecting the stack to potential toppling. This is sometimes circumvented by having a multi-ply or multi-layer sidewall, wherein a stacking tab extends upwards from an inner layer of the sidewall, thereby aligning the stacking tabs with the bottom panel of an adjacent container as opposed to the sidewall. This, however, requires excess paperboard to be used to create the multi-layer sidewall, and results in related increased costs.

Further, it is easy to misalign a container during stacking such that a higher container falls into a lower container, usually on an angle, potentially damaging the contents of the lower container. To solve this, several prior art patents have devised tapered sidewalls, wherein the distance between the opposing top edges of the sidewalls is less than the distance between the opposing lower edges of the sidewalls. This eases stacking by severely limiting the probability of the higher container falling into a lower container, since the narrower upper portion creates a more functional ledge for the base of the higher container to rest on.

Therefore, it is an object of this invention to provide a paperboard container with a stacking structure that has tapered sidewalls and stacking tabs, resulting in a narrower top footprint than the bottom footprint, and wherein the stacking tabs are secured on all four sides by an adjacently stacked container.

Still further, diagonally extending reinforcing corner panels are sometimes provided on conventional containers to reinforce the container and assist in preventing an upper container from falling into a lower container when they are stacked. The diagonal corner panels or posts in these containers extend the full height of the container, and therefore require additional material and concomitant increased cost to form.

Accordingly, it is a further object of this invention to provide reinforcing structure at the top edges of the container, using a minimum amount of material, and defining panels extending diagonally across only an upper portion of the corners of the container to reinforce it and provide structure that assists in preventing an upper container from falling into a lower container when they are stacked.

SUMMARY OF THE INVENTION

The present invention comprises a container that may be used for transporting food items, wherein the container has a bottom or base panel, two opposing sidewalls, two opposing end walls, and stacking tabs extending upwardly from either the end walls or the sidewalls, co-planar to the side or end walls. The container's sidewalls or end walls are inwardly inclined or tapered, such that the angle between the sidewalls or end walls and the base panel is less than 90°. As a result, the tabs that extend co-planar from the end or sidewalls are likewise tapered at the same angle. The container further has locks formed by slots or openings scored and cut in the base panel of the container, wherein the tapered stacking tabs of the container extend through the cut-out slots in the bottom of an adjacently stacked container.

The tapered side or end walls of the container and the corresponding tapered stacking tabs ensure that the stacking tabs fit into slots cut from the base panel, and not the side or end walls, of an adjacent stacking container, thereby capturing the tabs in the slots and allowing the containers to securely stack without requiring excess paperboard material. Further, the tapered sidewalls lessen the distance between the top edges of opposed side or end walls relative to the distance between their bottom edges, thereby preventing unwanted slippage of an upper container into a lower container by providing a better supporting ledge for a container when it is stacked on top of another like container. The combination of these features results in containers that are easy to stack and container stacks that are not prone to toppling, without using excess paperboard.

One embodiment of the invention includes locks, comprising a cut-out slot coupled with a flap, wherein the flap can bend upwards, thereby better accommodating a tapered stacking tab. Further, as stacking of adjacent containers is only possible if the pattern of the cut-out slots is configured in the same pattern as the stacking tabs, the locks are positioned to engage and lock the stacking tabs in a specific configuration. Therefore, the locks of the present invention can be scored and cut in any arrangement to fit on various arrangements of stacking tabs. For example, the base panel may contain four locks in a particular arrangement to accommodate four stacking tabs of a particular arrangement. Similarly, the locks may be inwardly spaced at different distances from an outer edge of the base panel to accept stacking tabs that are tapered at various angles.

Other embodiments include containers with reinforcement flaps made of flexible material such as paperboard to create a partial top structure or ledge in the upper part of the container walls to help prevent bulging of the walls. The reinforcement flaps lie flush against the upper sides of the container, thereby increasing the thickness of the upper sides and any stacking tabs extending upwardly therefrom. The reinforcement flap may also create a supporting gusset or corner post in the corners of the container. The corner posts and increased thickness of the stacking tabs further increases the strength of a stack and reduces the likelihood of a higher container falling into a lower container in the stack.

Other objects, embodiments, features and advantages of the present invention will be apparent when the description of preferred embodiments of the invention are considered in conjunction with the annexed drawings, which should be construed in an illustrative and not limiting sense.

BRIEF DESCRIPTION OF THE DRAWINGS/FIGURES

DETAILED DESCRIPTION OF THE PREFERRED EMBODIMENTS

Figure 1:
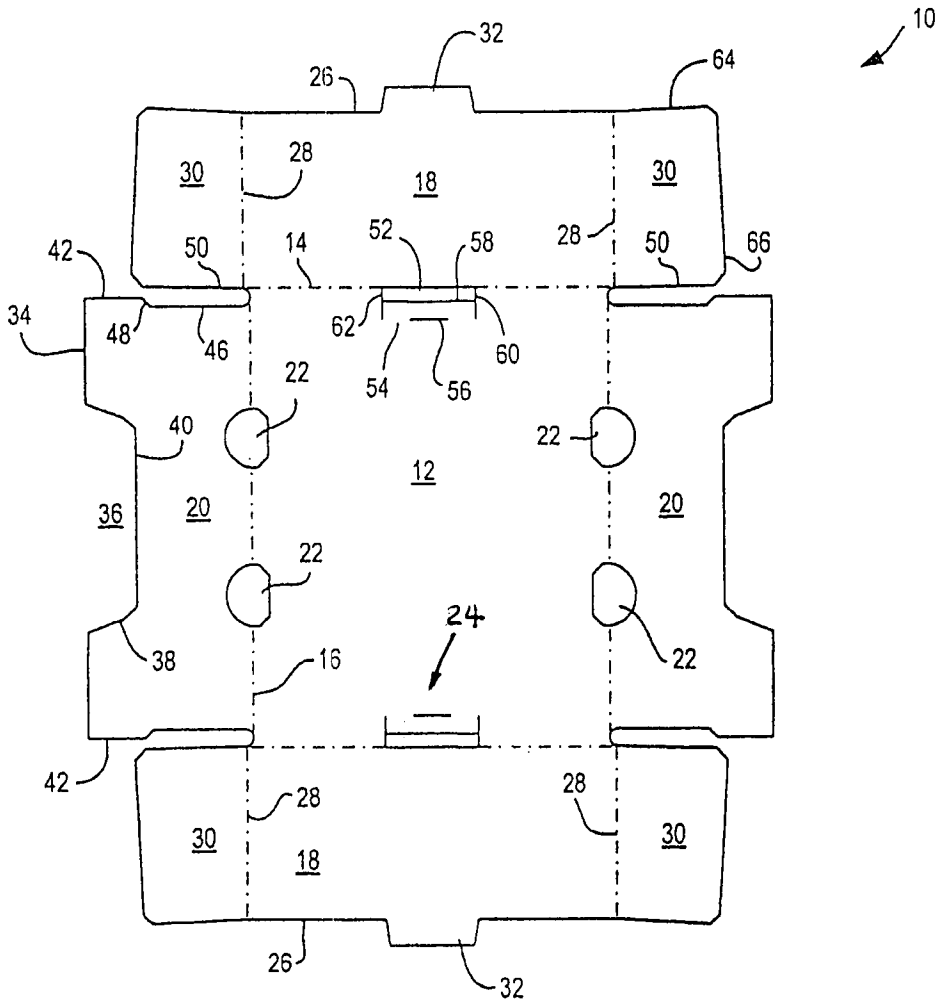
FIG. 1 is a plan view of a first embodiment of a container blank having tapered end walls and tapered stacking tabs extending coplanar therefrom.

A paper or paperboard blank scored in accordance with a first embodiment of the invention is shown in FIG. 1. Blank 10 is scored for the purpose of folding into a container suitable for holding, shipping or stacking a wide variety of objects, such as perishable agricultural products. The blank can be made of any material known in the art that is suitable for the shipping and transporting of a wide variety of food items, and preferably is a flat sheet of corrugated paper or paperboard. Different thicknesses of material can be used for packaging heavier products.

Base panel 12 is a substantially rectangular panel bordered by end fold lines 14 and side fold lines 16. End panels 18 foldably connect to base panel 12 along fold lines 14, and side panels 20 foldably connect to base panel 12 along fold lines 16. The base, end and side panels correspond to the bottom (or base), end, and sidewalls of a container erected from the blank. As such, the terms "panel" and "wall" are used interchangeably herein. Holes 22 are provided alongside fold lines 16 to provide breathing holes and access for an automated machine to manipulate and fold the blank into a fully erected container. Locks 24 are cut and scored in the base panel and may be adjacent fold line 14 as shown in FIG. 1, or inwardly spaced from fold line 14 a predetermined distance, depending upon the desired or necessary configuration.

End panels 18 are generally rectangular panels that form end walls when the container is fully erected. Accordingly, the length of end panels 18 in blank 10 corresponds to the height of the end wall 18 in an erected container. In the present example, the length (distance between the fold line 14 and free edge of the panel) of the end panel is 4¼ inches. However, the length of the panel, and corresponding height of the erected container, can vary widely within the scope of the invention. Each end panel 18 is bordered on four sides by an upper edge 26, fold line 14, and two outer fold lines 28. End flaps 30 foldably attach to each end of each end panel along fold lines 28. Stacking tab 32 extend outwardly from upper edge 26, coplanar to side panel 18.

End flaps 30 are substantially rectangular panels bordered on four sides by top edge 64, end edge 66, bottom edge 50, and fold line 28, wherein the bottom edge 50 of the flap extends upwardly toward the top edge 64 at a slight angle relative to the bottom edge of the end panel 18 as defined by the fold line 14, thereby causing the end panel 18 to taper or lean in at its top when the panel is erected. The angle can vary greatly, depending on how much of a taper is ultimately desired in the end panel. In this embodiment, an angle of 1-5° is preferable. Similarly, top edge 64 extends at a slight angle relative to edge 26, and generally parallel to edge 50. The angle of divergence of the top edge is ideally the same as the angle of divergence of the bottom edge. For example, if bottom edge 50 diverges from fold line 14 at an angle of 3°, top edge 64 diverges from upper edge 26 at an angle of 3°. The equivalent angle of divergence allows upper edge 26 and top edge 64 to create a flat, even top corner even as the end panel is tapered.

Each lock 24 on base panel 12 has a cut-out slot 52 coupled with a bendable flap 54, wherein the slot is designed to engage and secure stacking tabs 32 of an adjacent container. To fully engage and accept a stacking tab that enters through cut slot 52 on an angle, flap 54 has the ability to bend upwards along a back cut line 56. Flap 54 has a length, width and thickness, wherein the thickness is equal to the thickness of the base panel 12, and the length and width can vary within the scope of the invention as long as the flap sufficiently engages a stacking tab to frictionally hold it in the slot 52. The flap is bordered by contact edge 58, back cut line 56, and side cut lines 60 and 62. Contact edge 58 is the part of the flap that engages and holds secure stacking tabs 32 by rubbing against the tabs and holding them secure with a frictional force. Back cut line 56 is preferably a small cut line upon which flap 54 can pivot, and extends parallel to contact edge 58 and perpendicular to side cuts 60 and 62. However, the back cut line does not run the full length of contact edge 58, but is located intermediate and spaced from the side cuts 60 and 62. In alternate embodiments, the back cut line is a perforated cut line that runs between side cuts 60 and 62.

Cut lines 60 and 62 are incisions that extend laterally from the back of flap 54 to the fold line 14, parallel to each other and downwardly though the entire thickness of the panel 12. The cut lines enable the flap to extend upward about the back cut line without encountering undue resistance from the part of base panel 12 that borders flap 54.

Contact edge 58 extends from cut line 60 to cut line 62 parallel to fold line 14, and engages tab 32 when it is inserted through slot 52, holding the tab securely in place. In the present embodiment, the contact edge extends in a straight line. However, the shape of the contact edge may be altered in other embodiments. For example, as shown in FIGS. 2, 3 and 5-10, contact edge 58 can extend in a slight, tongue-shaped outward arc. In this circumstance, the outermost portion of the flap 54, or the portion that is furthest from the back cut line 56, will be the part of the extension that contacts the stacking tabs.

Cut-out slot 52 lies between flap 54 and fold line 14, and is further bordered by side cuts 60 and 62. The slot's width is great enough so that stacking tabs 32 can extend through the slot between the side cuts. However, the length between contact edge 58 and fold line 14 may be less than the thickness of the stacking tabs, enabling the tabs to press against a portion of flap 54, causing the flap to bend upwards to accommodate the tab.

Each slot 52 is aligned to accept a stacking tab on a slight taper. If the degree of taper changes, the alignment can change accordingly. For example, if sidewalls 18 taper a higher degree than shown in FIG. 1, the stacking tabs 32 will contact the base panel 12 of an adjacent container at some point closer to the center of base panel 12. To account for this, the slots can be inwardly spaced from fold line 14, thereby being aligned to accept the tabs.

Side panels 20 are generally rectangular panels each bordered on four sides by an upper edge 34, side fold line 16, and side edges 42. The side panels 20 may have a recess 36 to provide visibility of the items inside the container. Side panels 20 form the sidewalls when the container is fully erected. Accordingly, the length of side panels 20 (i.e., the distance from fold line 16 to upper edge 34) in blank 10 corresponds to the height of the sidewalls of the erected container in FIG. 2. Ideally, this height of side panel is the same as the height of the end panel 18. In the present example the height is 4¼ inches.

The container is erected either manually or by an automated machine. Generally it is done with an automated machine, wherein base panel 12 is pushed downward, forcing end panels 18 and side panels 20 to simultaneously fold upwards along fold lines 14 and 16, respectively. End flaps 30 are then folded along fold lines 28 and are adhered to the outer surface of side panels 20 with a hot melt adhesive. When this happens, bottom edge 50 aligns with fold line 16, pulling down end flaps 30 at an angle, thereby causing a taper in end panel 18. The taper of the end panel may be slight, preferably between 1-5°, although this can vary widely within the scope of the invention depending on the angle of divergence of bottom edge 50. The result of the taper is that the end panel 18 subtends an acute angle, i.e., less than 90°, with the base panel 12. The corresponding angle of the stacking tabs relative to the base panel is therefore also less than 90° due to their extending coplanar with the end panels. In alternate embodiments, the end flaps can be adhered to the outer surface with another means, such as staples.

Figure 2:
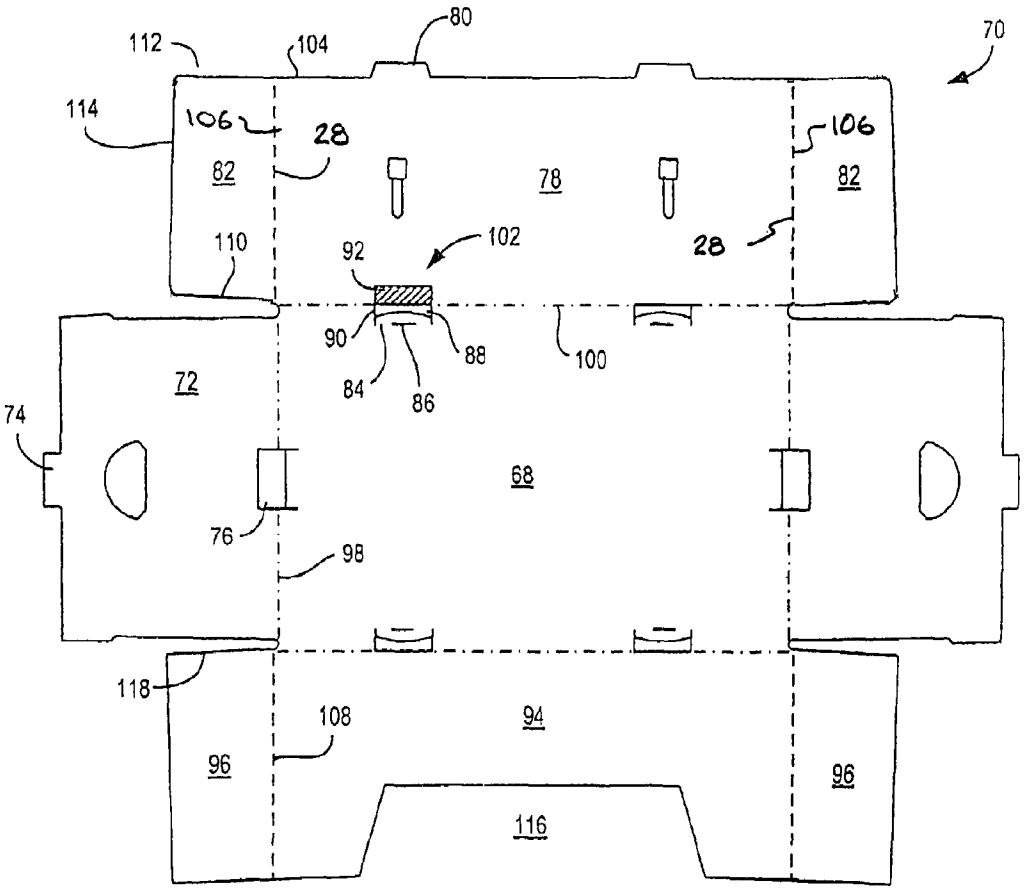
FIG. 2 is a plan view of a second embodiment of a container blank having tapered sidewalls and tapered stacking tabs extending coplanar therefrom.

FIG. 2 shows a second embodiment, wherein the sidewalls and the corresponding stacking tabs on the sidewalls are tapered. Base panel 68 is a generally rectangular panel bordered on four sides by end fold lines 98 and side fold lines 100. End panels 72 and side panels 78 and 94 are foldably connected to base panel 68 along fold lines 98 and 100, respectively. Further, the bottoms of end panels 72 contain notches 76 that partially extend into the base panel, traversing fold line 98, and locks 102 are cut out of base panel bordering fold lines 100.

Side panel 78 is a generally rectangular panel that corresponds to at least one sidewall when the container is fully erected. Accordingly, the length of side panels 78 in blank 70 corresponds to the height of the sidewall when the container is erected. In the present example, the length of the side panel is 9 11/16 inches, but the exact length can vary widely within the spirit of the invention. Each side panel 78 is bordered on four sides by an upper edge 104, side fold line 100, and two opposing side panel fold lines 106. Side flaps 82 foldably attach to each side panel along fold lines 106. One or multiple stacking tabs 80 extend outwardly from upper edge 104, coplanar to side panel 78.

Side flaps 82 function in largely the same manner as end flaps 30 on blank 10 in FIG. 1A. Flaps 82 are substantially rectangular panels, wherein bottom edge 110 and top edge 112 both diverge at a slight angle relative to the bottom and top edges of the sidewall, thereby causing the side panel 78 and corresponding stacking tabs 80 to taper or lean inwardly when the side panel is erected. Like flap 30 in FIG. 1A, bottom edge 110 extends generally in the same lateral or horizontal plane as fold line 100 (i.e., a bottom edge of sidewall 78) except it extends or diverges upwardly at a slight angle relative to the fold line 100. Likewise, top edge 112 extends largely in the same lateral or horizontal plane as upper edge 104, except it diverges with a slight upward angle relative to the upper edge 104. The angle of divergence of the top edge is ideally the same as the angle of divergence of the bottom edge. This allows top edge 112 and upper edge 104 to create a flat, even top corner even when the sidewall is tapered.

In FIG. 2, only one of the sidewalls, sidewall 78, includes stacking tabs 80 integrally attached, extending coplanar from the upper edge of the sidewall. The other sidewall, sidewall 94, foldably connects to the base panel along fold line 100 and opposite to sidewall 78. Sidewall 94 is a generally rectangular shape with a large, trapezoidal recess 116 providing side view visibility and breathing holes for the items held within. Side flaps 96, which are foldably connected to side panel 94 along fold lines 108, function in the same way as side flaps 82. However, flaps 82 and 96 need not be identical. For example, in FIG. 2, the angle of divergence of bottom edge 118 of side flap 96 is greater than the divergence of bottom edge 110 of side flap 82. As a result, sidewall 94 has a more severe taper than sidewall 78. However, the angle of divergence of bottom edge 118 can vary widely within the spirit of the invention. Further, sidewall 94 may be replaced by a sidewall substantially similar in configuration to sidewall 78. For example, sidewall 94 may have stacking tabs extending coplanar from the upper edge of the wall instead of having the recess 116.

End panels 72 are generally rectangular panels that correspond to the end walls when the container is fully erected. Accordingly, the length of end panels 72 corresponds to the height of the end walls of the erected container. Ideally the height of end panels 72 is similar to that of sidewalls 78 and 94, although not necessarily identical. In the present example, the height is 9¾ inches. End panels 72 further comprise stacking tabs 74 extending co-planar with the end wall. The bottoms of end panels 72 contain notches 76, proportioned and positioned to engage and hold a stacking tab 74 of an adjacently stacked container. Neither end panels 72 nor the stacking tabs 74 are tapered in the example shown.

Locks 102 in FIG. 2 are scored, cut, and function much the same way as locks 24 in FIG. 1A. Each lock 102 has a cut-out slot 88 coupled with a flap 84, wherein the slot is designed to engage and secure a tapered stacking tab 80 of an adjacent container. To fully engage and accept a tapered stacking tab, flap 84 has the ability to bend upwards along the back cut line 86. Contact edge 90 engages and holds secure a stacking tab 80 by rubbing against the tab, and holding it secure with a frictional force. In the present example, contact edge 90 is tongue shaped, with the center of the edge being closer to fold line 100 than the sides of the edge. Alternatively, the contact edge may run parallel to the fold line, like locks 24 in FIG. 1A. Other embodiments include extensions of other shapes and arrangements, such as a concave arc.

Locks can be scored on one or both opposing sides of base panel 68. FIG. 2 shows locks scored on opposing sides of the base panel. This is advantageous by allowing one container to stack on top of another even if the north-south orientation of a container is opposite from the adjacent container.

Sidewall 78 may further include a crushed area 92 that borders cut-out slot 88 across fold line 100, wherein the crushed area comprises a section of the sidewall that is pressed to a point wherein the thickness of the crushed area is less than the thickness of the sidewall. The crushed area allows easier access of a stacking tab 80 of an adjacently stacked container into the slot 88 in embodiments where the taper of sidewall 78 is very slight.

Blank 70 is preferably erected in the same manner as blank 10, through use of an automated machine that folds end panels 72 and side panels 78 and 94 upwards along fold lines 98 and 100, respectively, and adhering side panel flaps 82 and 96 to the outer side of end panels 72 with a hot melt adhesive or other adhering means, such that bottom edges 110 and 118 align with fold line 98, causing a taper in the sidewalls.

Figure 3:
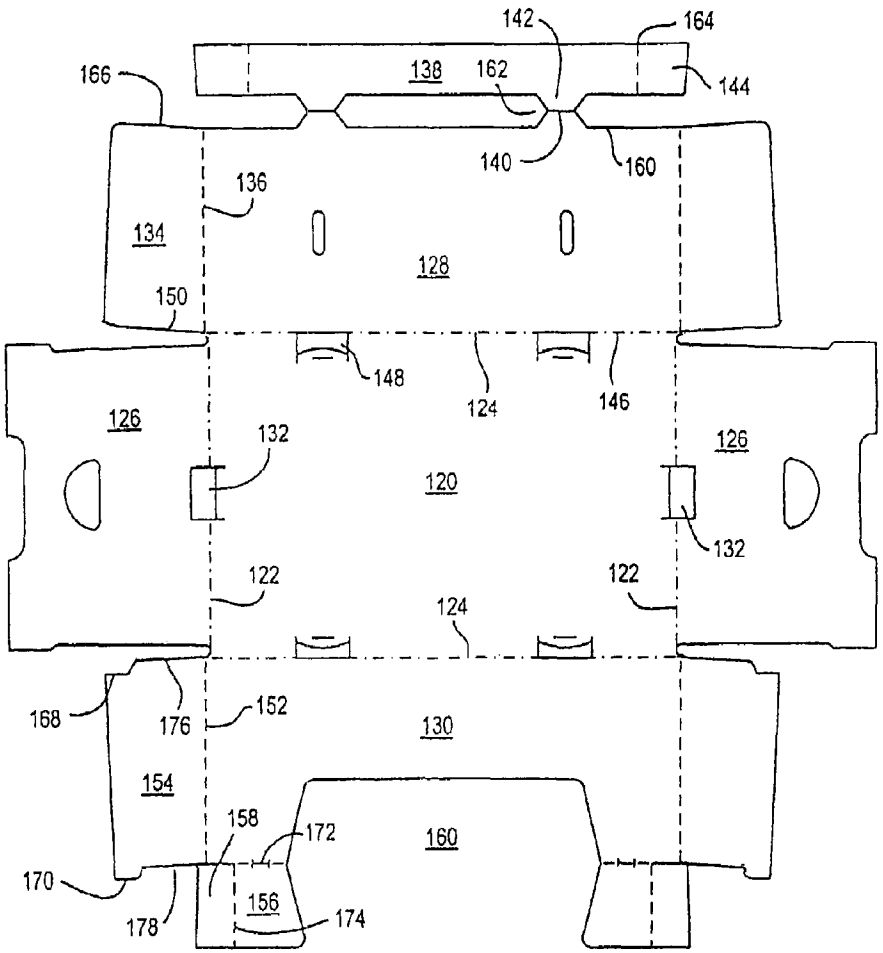
FIG. 3 is a plan view of a third embodiment of a container blank having reinforcement flaps, tapered sidewalls and tapered stacking tabs extending co-planar therefrom.

A third embodiment of the container is seen in FIG. 3. Here, a narrow reinforcement flap 138 is added to the top of sidewall 128 to reinforce the sidewalls and stacking tabs and to create a partial top structure or larger top ledge on the top portion of the sidewalls to enhance stackability. The reinforcement flap is a long, thin band of flexible material similar in width to the sidewalls, but considerably shorter in length than the sidewalls (i.e., extending over only a small portion of the height of the sidewall), thereby requiring less material and lowering production costs. The reinforcement flap further comprises small corner flaps or corner posts 144 foldably attached along opposing fold lines 164 on the reinforcement flap's opposite ends, and at least one tab reinforcement 142 integrally attached to the reinforcement flap along one of its longer edges. Sidewall 128 of FIG. 3 is similar to sidewall 78 in FIG. 2. Specifically, tapered sidewall 128 is bordered by a side fold line 124, two opposing end fold lines 136, and an upper edge 160. Stacking tabs 140 extend outward from upper edge 160, coplanar with sidewall 128. Side flaps 134 are foldably attached to sidewall 128 along fold lines 136, and have a bottom edge 150 that diverges from fold line 124 and a top edge 166 that diverges from upper edge 160, wherein the angle of divergence is the same for top edge 166 and bottom edge 150. In the embodiment shown, edge 150 has a greater angle of divergence than bottom edges 50 and 110 of the prior embodiments shown respectively in FIGS. 1 and 2. The amount of the increased taper, if any, can vary widely in the spirit of the invention.

Figure 4:
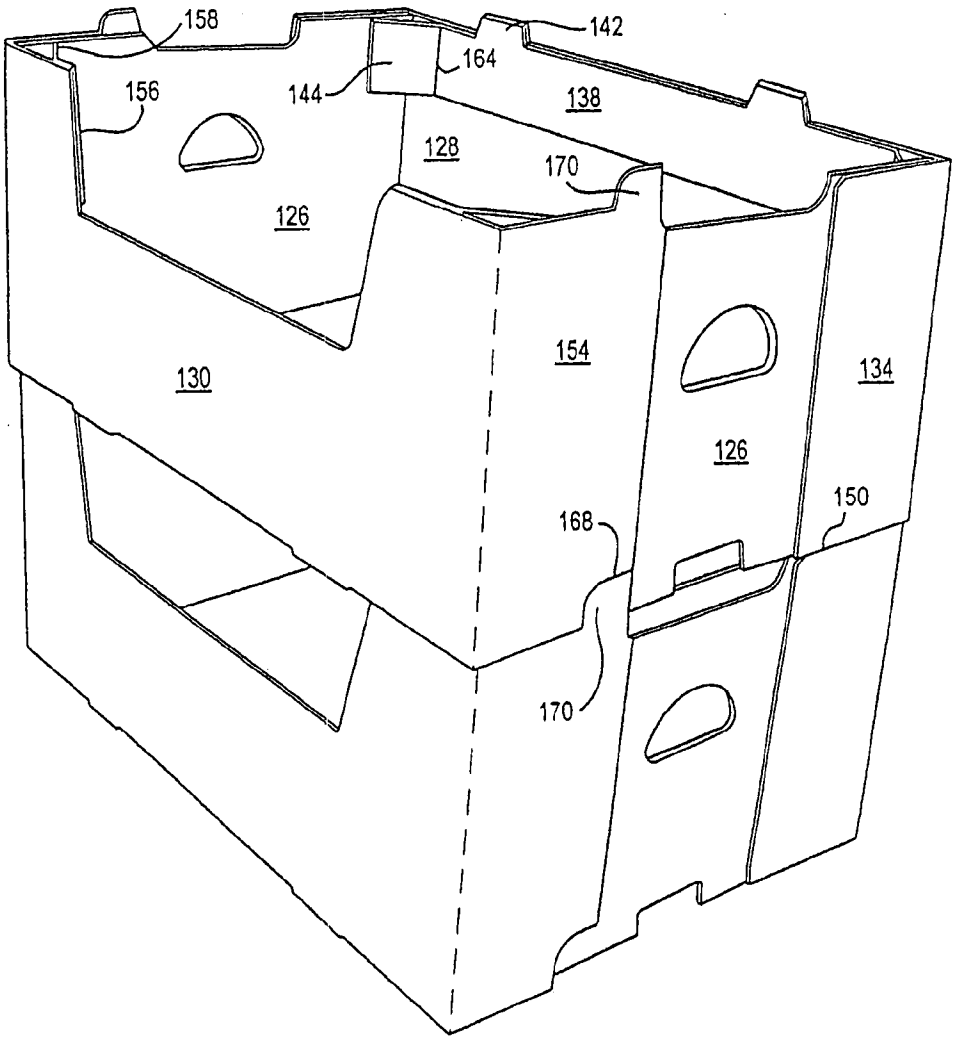
FIG. 4 is a top perspective view of a pair of containers made from the blank of FIG. 3, showing them in stacked relationship.

Reinforcement tabs 142 foldably connect to the top edge of stacking tabs 140 along fold line 162. When the container is erected, side panel 128 is folded upwards along fold line 124. Reinforcement flap 138 is then folded downward along fold line 162 until the face of the reinforcement flap is flush against the top of the inner surface of panel 128, as seen in FIG. 4. Corner post 144 then partially folds along fold line 164 so that the corner post is diagonal to the corner of end wall 126 and sidewall 128. The diagonal corner post creates an upper ledge that increases the sturdiness of a container stack by preventing a container higher in the stack from falling downward into a lower container. Also, since the corner post only occupies the top portion of the corner of the container, there is more interior space in the container as compared to a corner post occupying the whole height of the corner as in prior art containers.

The combination of stacking tab 140 and reinforcement tab 142 is a larger, thicker tapered stacking tab extending from the upper side of the tapered sidewall. To account for this additional thickness, the cut-out slot 148 is wider to accommodate the larger, reinforced tab. The partial top created by reinforcement flap 138 provides bulge resistance to the sidewall 128. Also, since the reinforcement flap has a smaller length (i.e., height) than the sidewall 128, less material is required and there is slightly more usable interior space in the container as compared to using a reinforcement flap having the same width (i.e., height) as the sidewall. The remainder of the container blank in FIG. 3 is similar in function to that of FIG. 2. Additionally, however, sidewall 130 may have one or more small partial reinforcement flaps or reinforcement pieces 156, wherein the reinforcement piece 156 is attached to sidewall 130 along perforated fold line 172, and can fold over and lie flush against the inner surface of sidewall 130. The reinforcement piece 156 further has corner flaps or corner posts 158 foldably attached along fold line 174. The corner post folds along line 174 so that it is diagonal to the corner of sidewall 130 and end wall 126, mirroring corner posts 144. The diagonal corner post creates an upper ledge that increases the sturdiness of stacking container by preventing a container higher in the stack from falling downward into a lower container. Sidewall 130 further has side flaps 154 with a divergent bottom edge 176 and a diverging top edge 178, resulting in a taper of sidewall 130 when the container is erected.

Side flaps 154 may also contain a lengthened area 170, which is a small extension of paperboard extending from top edge 178, coplanar to flap 154, and defines an aligning tab. The lengthened area or tab 170 fits into a corresponding aligning notch 168 of an adjacently stacked container, as seen in FIG. 4. The notch is a recess in flap 154 positioned along bottom edge 176, to engage and secure the tab 170. This aligning tab and notch help to accurately align the containers when they are stacked on top of one another. It will be noted that by forming the tab and notch on the side flaps 154, the notch is in only an outer panel of the wall and does not penetrate through the thickness of the wall.

In alternative embodiments, the sidewall 130 may be replaced with a sidewall similar to the sidewall 128 of FIG. 3 or sidewall 78 or 94 of FIG. 2, wherein the sidewalls are tapered and may have tapered stacking tabs extending coplanar therefrom, wherein the tabs fit into slots cut from the base panel, and not the sidewall, of an adjacent stacking container.

Other embodiments are shown, for example, in FIGS. 5-10. As noted previously herein, prior open-top tapered tray styles utilized complete fold-over side or end panel structures (excessive material use) or no top structures to provide product support or bulge resistance for heavy products to be packed.

The partial top structure of the present invention adds bulge resistance, improves stacking tab integrity, and creates a small gusset/corner-post tray support to the units stacked above, while using minimum material. The stackable tapered tray can be machine or hand formed and made in various sizes (footprints) to accommodate a multiple of stacking tabs per side/end panels. Display windows can also be formed on either the side or end panels.

Figure 5:
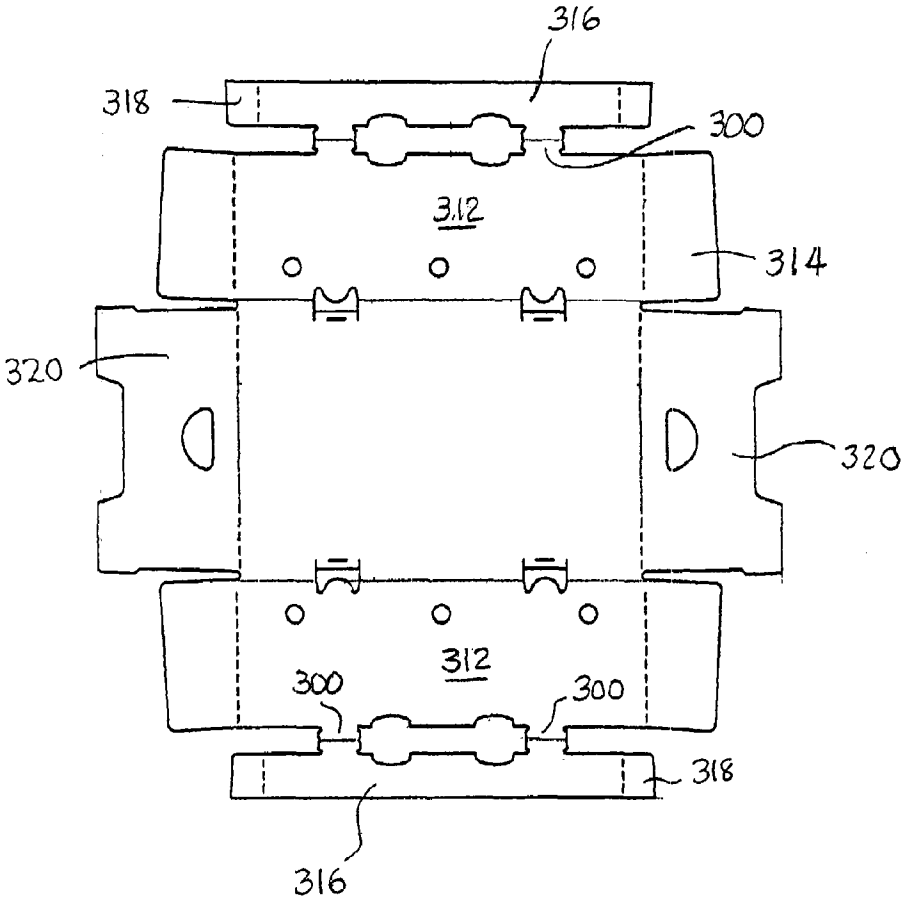
FIG. 5 is a plan view of a blank for making a fourth embodiment of the invention, wherein narrow reinforcing flaps and short diagonal corner posts are formed on the upper edges of opposed sidewalls.
Figure 6:
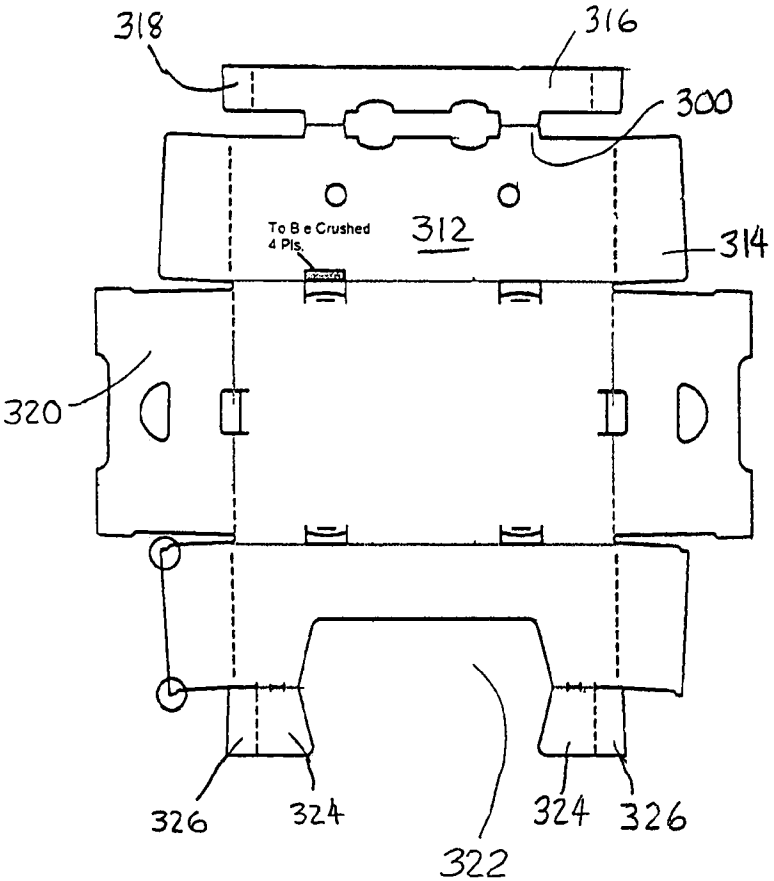
FIG. 6 is a plan view of another blank for making a fifth embodiment, similar to FIG. 5, but with a substantially full-length reinforcing flap on only one side and a cutout in the opposite wall forming a display window, with only partial reinforcement flaps on that wall.

The designs shown in FIGS. 5 and 6 are end-slotted trays forming stacking tabs 300 positioned on the side panels 312, which will be inverted and tapered when the tray is machine formed. The tapered panel 314 positions the stacking tabs 300, which extend in the same plane as the panel, to be enclosed or captured by the slot in the base panel of a tray stacked on top, thus creating an excellent unit alignment for transporting. The fold-over top structure 316 is part of the side panel and is mechanically formed to create the top bulge-support structure while forming a small gusset/corner-post 318 to the end panel structure 320. FIG. 6 offers a side panel display window 322 option with separate partial fold-over structures 324 joined with a gusset/corner-post 326 formed on each end panel structure 320.

Figure 7:
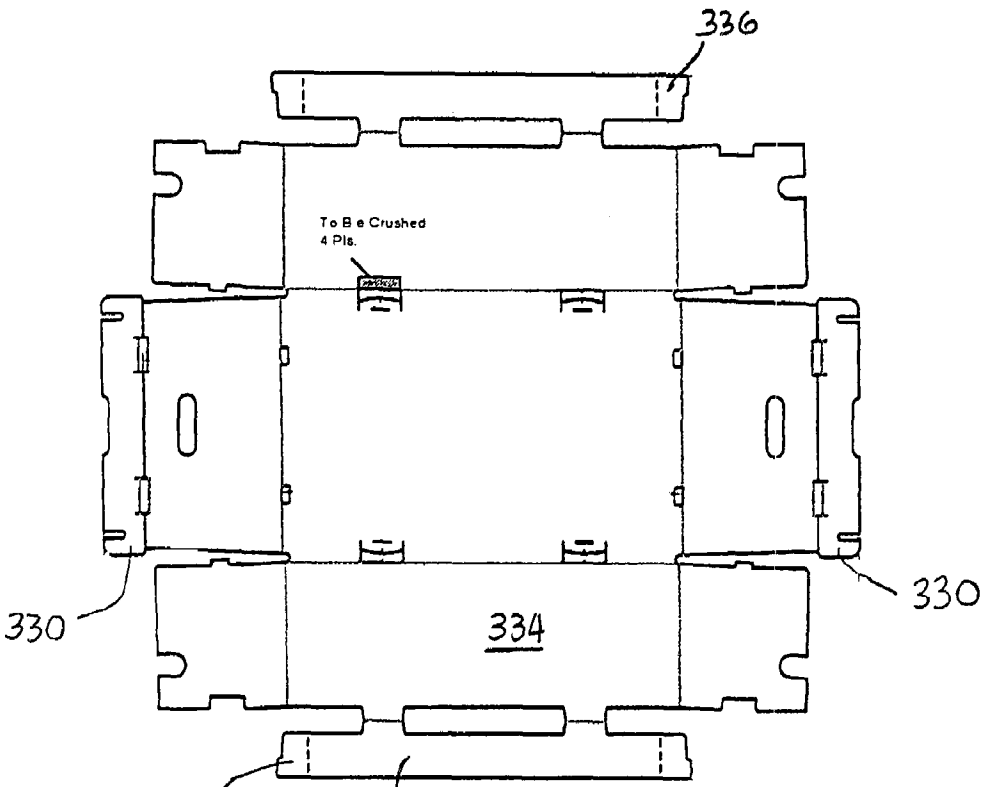
FIG. 7 is a plan view of a still further blank for making a sixth embodiment of a container according to the invention, wherein narrow reinforcing panels or flaps are formed on the upper edges of both the sidewalls and the end walls.
Figure 8:
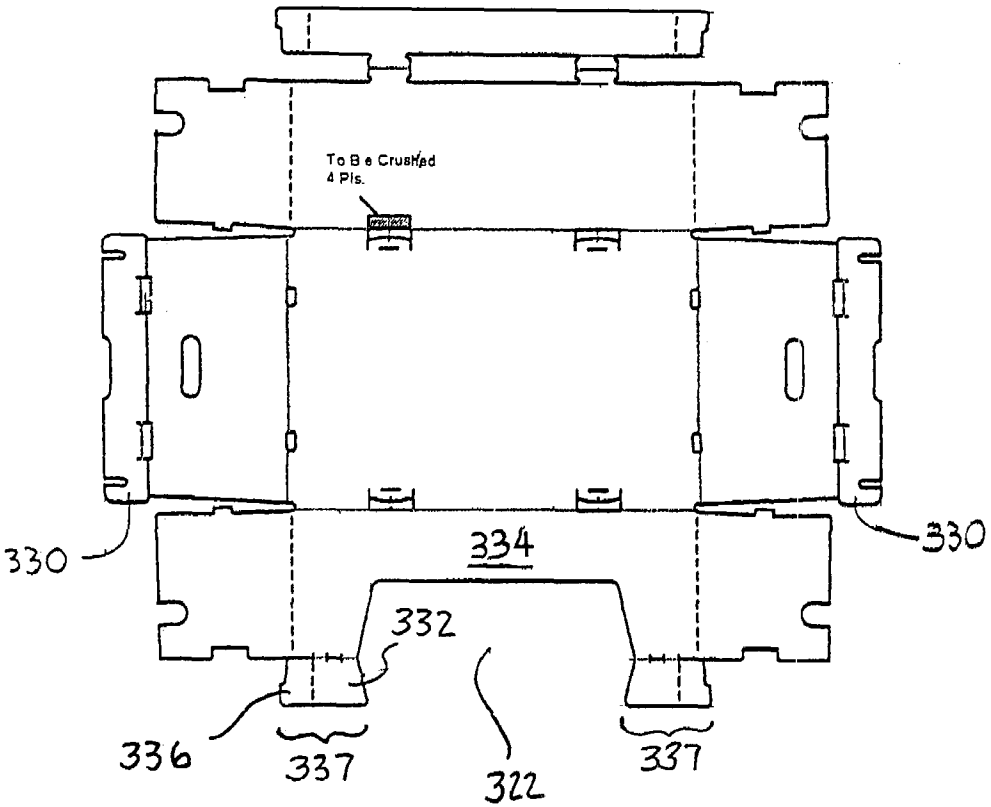
FIG. 8 is a plan view of yet another blank for making a seventh embodiment of a container according to the invention, wherein the blank is similar to that shown in FIG. 7, but with a cutout forming a display window in one of the sidewalls, and only partial reinforcing flaps on that wall.

The designs shown in FIGS. 7 and 8 are end-slotted trays that can be hand set-up with end panel locking devices 330. The fold-over top structure 332 of the side panel 334 is hand formed with gussets/corner-posts 336 that lock into end panel locking devices 330 previously formed. FIG. 8 has a display window option (like FIG. 6) forming separate partial fold-over structures 337.

Figure 9:
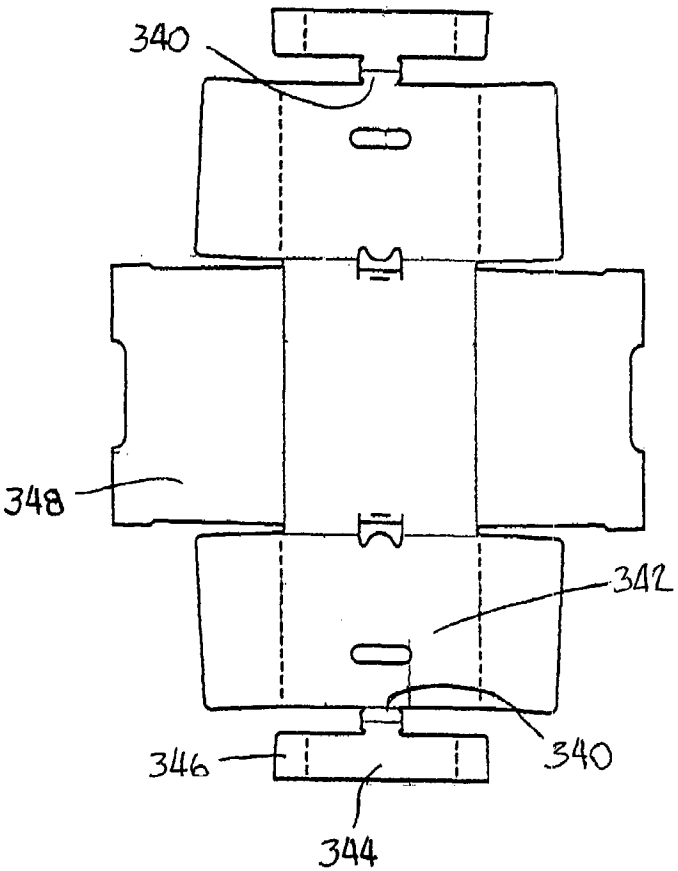
FIG. 9 is a plan view of a blank for making an eighth embodiment, wherein narrow reinforcing flaps are formed on the upper edges of only the end walls.
Figure 10:
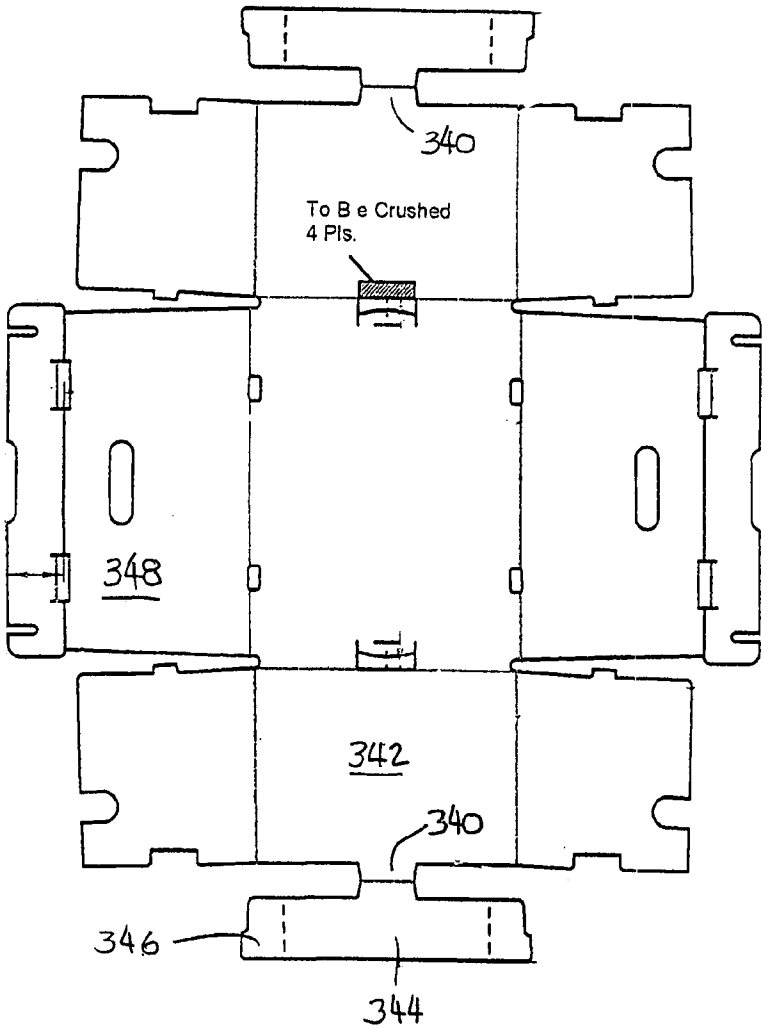
FIG. 10 is a plan view of a blank according to a ninth embodiment, wherein reinforcing flaps are formed on all the walls.

The designs shown in FIGS. 9 and 10 are side-slotted trays with stacking tabs 340 positioned on the end panels 342, which will be inverted and tapered when the tray is formed. The fold-over top structure 344 is part of the end panel 342 and is mechanical- (FIG. 9) or hand- (FIG. 10) formed with a gusset/corner-post 346 formed on side panel 348.

Figure 11:
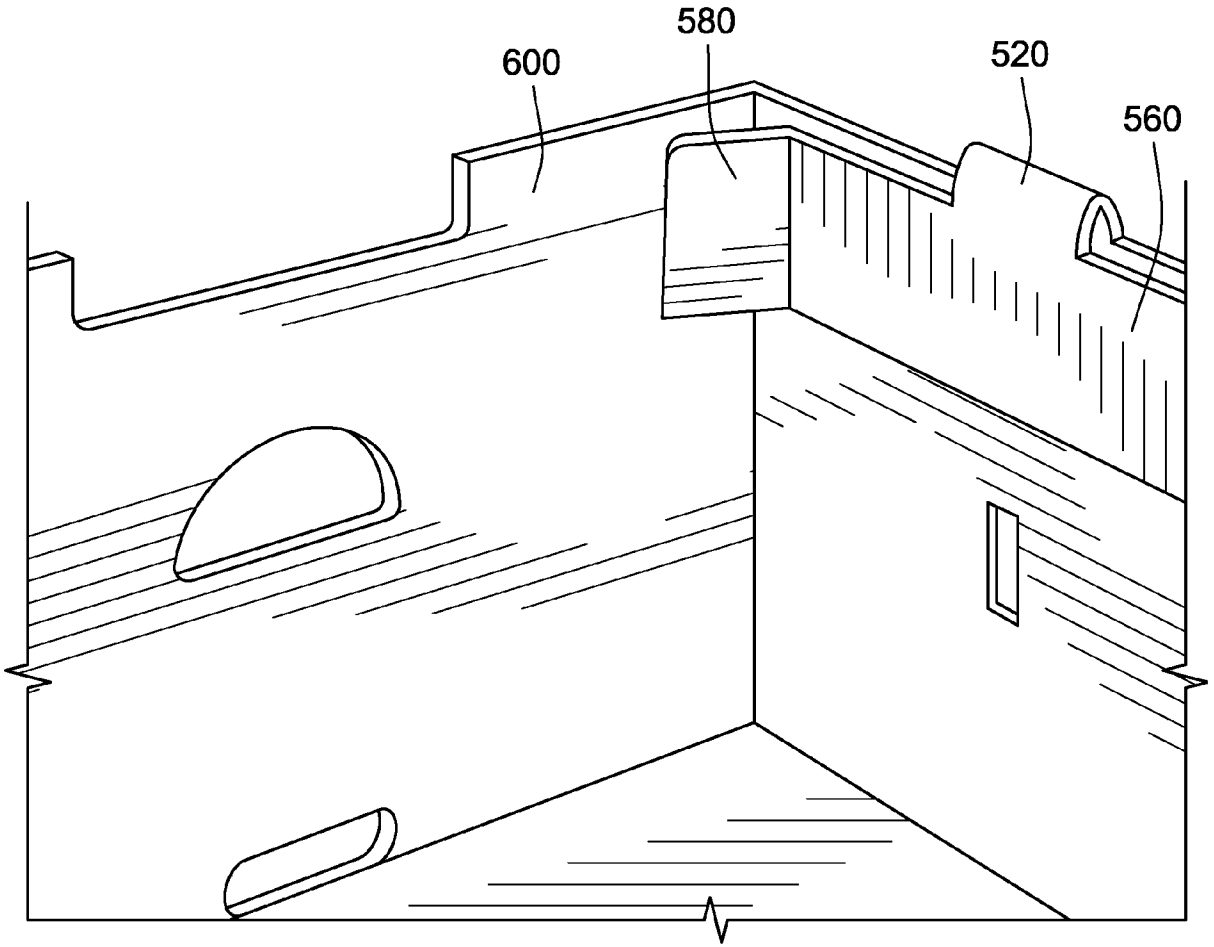
FIG. 11 is an enlarged fragmentary top perspective view looking toward one side of the interior of a container according to the invention, such as the embodiment shown in FIGS. 3 and 4.
Figure 12:
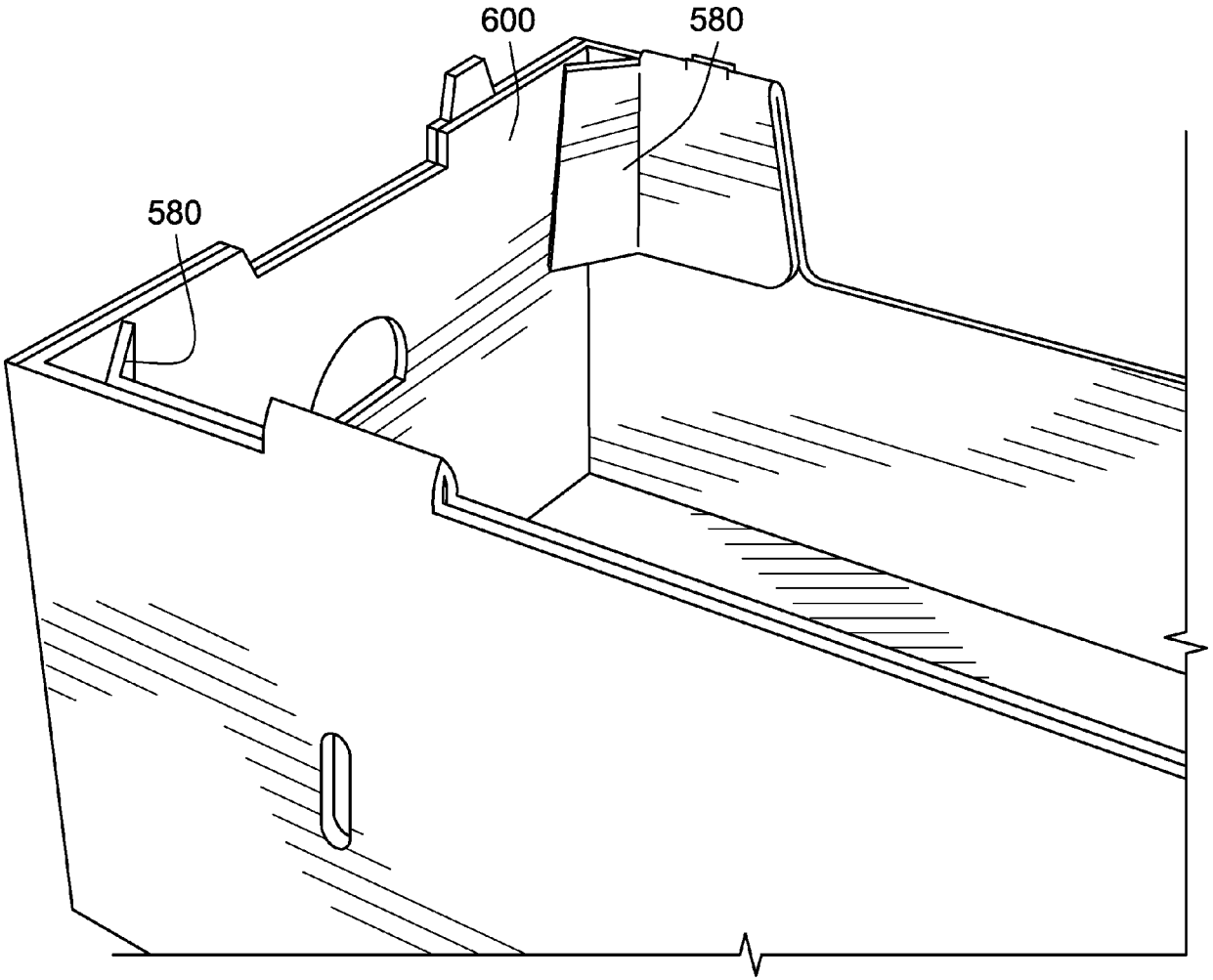
FIG. 12 is a slightly smaller scale fragmentary top perspective view looking toward the other side of the interior of the container shown in FIG. 11.
Figure 13:
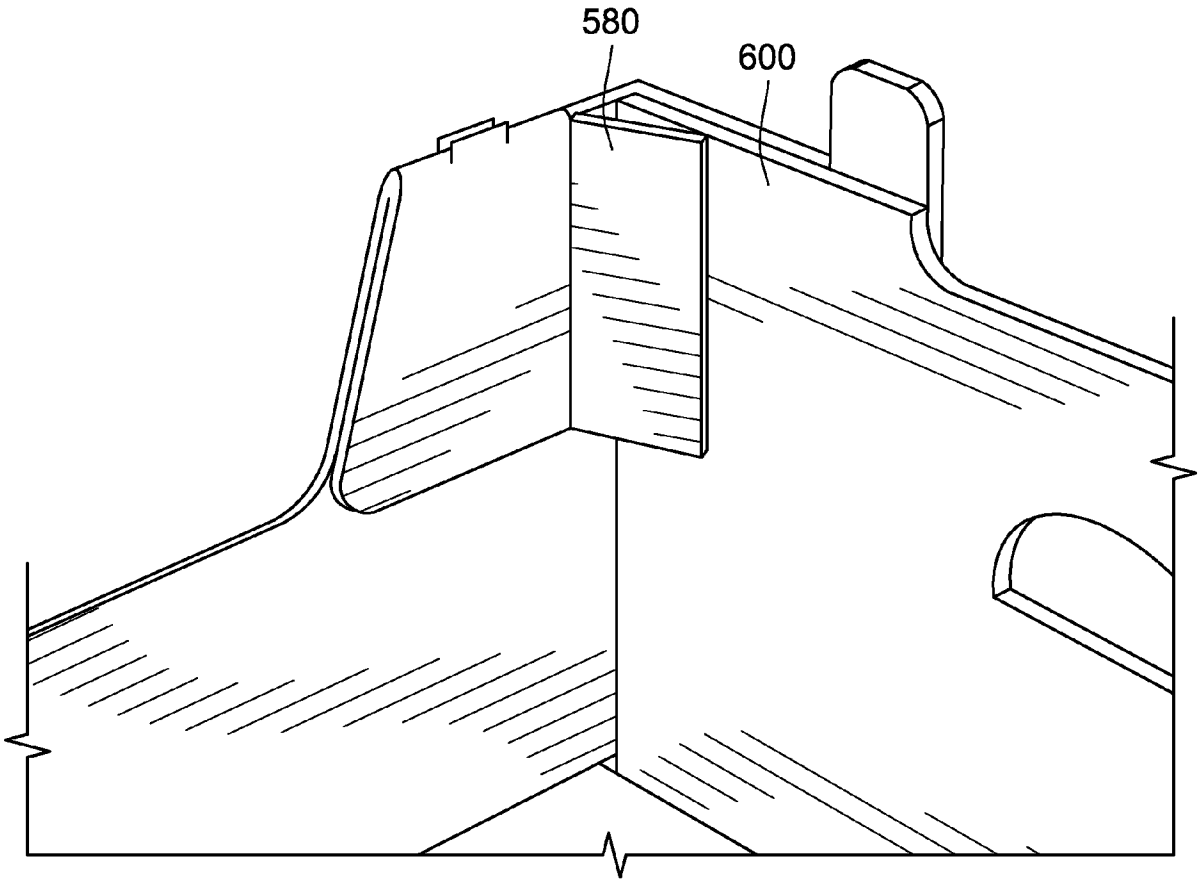
FIG. 13 is a greatly enlarged fragmentary top perspective view of the same interior corner of the container shown in FIG. 12.

FIGS. 11, 12 and 13 show details of the reinforcing flange and corner gusset post of the invention. FIG. 11 shows the side panel's fold-over top structure 560 after it has been mechanically formed, inverted and tapered, and the top bulge-support structure that forms a small gusset/corner-post 580 to the end panel structure 600. Stacking tabs 520 are also formed by this structure. FIGS. 12 and 13 show the gusset/corner-posts 580 at the corners of the side with the display window.

Although the invention has been described with reference to preferred embodiments, it will be appreciated by one of ordinary skill in the art that numerous modifications are possible in light of the above disclosure. For example, the stacking tabs extending co-planar from the tapered end walls and sidewalls may be different shapes than the tabs depicted in the drawings without departing from the spirit of the invention. Further, although the embodiments in FIGS. 1-4 show rectangular shaped containers, it is to be understood that square or cube shaped containers are within the spirit of the present invention. All such variations and modifications are intended to be within the scope and spirit of the invention as defined in the claims appended hereto.

What is claimed is:

1. A container comprising a base panel, a pair of opposing sidewalls, a pair of opposing end walls, and an open top, said container having an interior space and formed from a single unitary blank, wherein:

the sidewalls and end walls each have an upper edge;

a relatively narrow reinforcing flap is foldably joined to the upper edge of at least one of said pair of opposing sidewalls and said pair of opposing end walls, said reinforcing flap having a width from a top edge to a bottom edge thereof that extends over only a minor portion of the height of the associated side wall, said reinforcing flap is joined to the upper edge of one of said sidewalls;

a central portion of the upper edge of the opposite sidewall is recessed over a major portion of the length thereof, leaving relatively short upper edge portions at opposite ends of said opposite sidewall;

short reinforcement pieces are foldably attached to said short upper edge portions, said short reinforcement pieces having a width from an upper edge to a lower edge thereof that is greater than the width of said reinforcing flap from an upper edge to a lower edge thereof;

a small corner post flap is foldably joined to each of opposite ends of said reinforcing flap, said corner post flap being substantially rectangular and having a width from a top edge to a bottom edge thereof that is substantially the same as the width of the associated reinforcing flap and extending diagonally across interior corners of the container at the upper edges of the sidewalls and end walls, in spaced relation to the base panel; and said container is reinforced by said narrow reinforcing flap and said small corner post flaps, leaving the interior space below said narrow reinforcing flap and small corner post flaps free of additional reinforcing structure, thereby resulting in greater interior space and requiring use of less material in the construction of the container.

2. The container according to claim 1, wherein:

at least one stacking tab extends upwardly from the upper edge of at least one of said pair of opposing sidewalls and said pair of opposing end walls; and at least one slot is cut into the base panel, said at least one slot being positioned to accept said at least one stacking tab of an adjacently stacked container.

3. A stackable container as claimed in claim 2, wherein:

said at least one of said pair of sidewalls and said pair of end walls subtend an acute angle with the base panel, whereby said at least one of said sidewalls and said end walls lean inwardly.

4. A stackable container as claimed in claim 3, wherein:

said at least one stacking tab extends upwardly from the upper edge of said sidewalls at the same angle therewith.

5. The container according to claim 2, wherein:

a said reinforcing flap is attached in overlapping relationship to an upper inner surface of each of said pair of opposing sidewalls to form a ledge, the reinforcing flap further comprising at least one reinforcement tab and said at least one corner post flap, wherein the at least one reinforcement tab lies flush against the at least one stacking tab, and the corner flap extends at a diagonal away from the first at least one sidewall toward one of the opposing end walls.

6. A stackable container as claimed in claim 1, wherein:

said reinforcing flap is on each of said sidewalls.

7. A stackable container as claimed in claim 6, wherein:

said sidewalls subtend an acute angle with said base panel.

8. A stackable container as claimed in claim 1, wherein:

one of said pair of sidewalls and said pair of end walls subtend an acute angle with the base panel, whereby said one of said pair of sidewalk and said pair of end walls lean inwardly; and at least one stacking tab extends upwardly from the upper edge of said one of said pair of sidewalls and said pair of end walls at the same angle therewith.

9. A stackable container as claimed in claim 1, wherein:

side flaps are foldably joined to opposite ends of each said sidewall, said side flaps having upper and lower edges; and an aligning tab on one of the upper and lower edges and a complemental aligning notch on the opposite edge, the aligning tab on one container being received in the aligning notch in an adjacent stacked container to align the containers.

* * * * *